US005124511A

United States Patent [19]

Miller et al.

[11] Patent Number: 5,124,511

[45] Date of Patent: Jun. 23, 1992

[54] FASTENING DEVICE FOR SECURING A SENSING EDGE TO A DOOR

[75] Inventors: Norman K. Miller; Bearge D. Miller, both of Concordville, Pa.

[73] Assignee: Miller Edge, Inc., Concordville, Pa.

[21] Appl. No.: 585,578

[22] Filed: Sep. 19, 1990

[51] Int. Cl.[5] ..... H01H 3/16; E06B 7/16

[52] U.S. Cl. ..... 200/61.43; 49/488

[58] Field of Search ..... 200/61.43; 49/27, 482, 49/488, 489

[56] References Cited

U.S. PATENT DOCUMENTS

| | | | |
|---|---|---|---|
| 3,056,628 | 10/1962 | Golde | 296/219 |
| 3,064,319 | 11/1962 | Miller | 49/488 X |
| 3,462,885 | 8/1969 | Miller | 49/488 |
| 3,896,590 | 7/1975 | Miller | 49/488 |
| 4,051,336 | 9/1977 | Miller | 200/61.43 |
| 4,349,710 | 9/1982 | Miller | 200/61.43 |
| 4,396,814 | 8/1983 | Miller | 200/61.43 |
| 4,908,483 | 3/1990 | Miller | 200/61.43 |
| 4,954,673 | 9/1990 | Miller | 200/61.43 |
| 4,972,054 | 11/1990 | Miller et al. | 200/61.43 |

*Primary Examiner*—J. R. Scott

*Attorney, Agent, or Firm*—Panitch, Schwarze, Jacobs & Nadel

[57] ABSTRACT

A fastening device for securing a sensing edge to a door edge. The fastening device includes a mounting plate having a first surface for being attached to the door edge and a second surface for attachment of the sensing edge. The sensing edge detects objects in proximity to the door edge and includes an elongate sheath compressible upon application of external pressure and a switch for actuating an electrical device upon compression of the sheath. A pair of male and female members are interconnected between the mounting plate and the sheath to releasably secure the sensing edge to the mounting plate and to thereby allow the sensing edge to be releasably secured to the door edge.

8 Claims, 2 Drawing Sheets

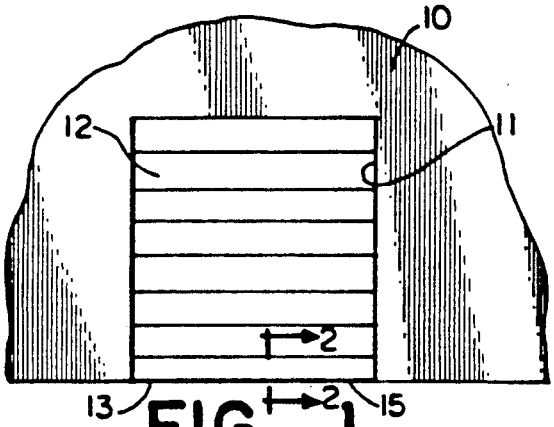
FIG. 1
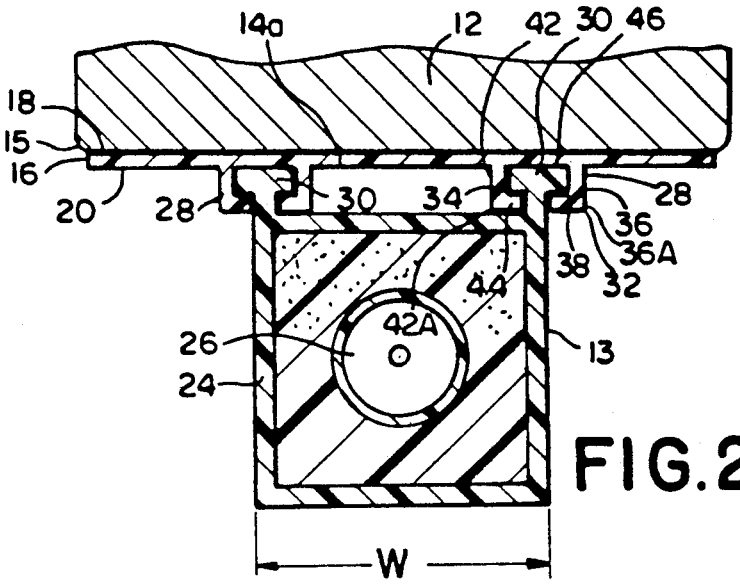
FIG. 2
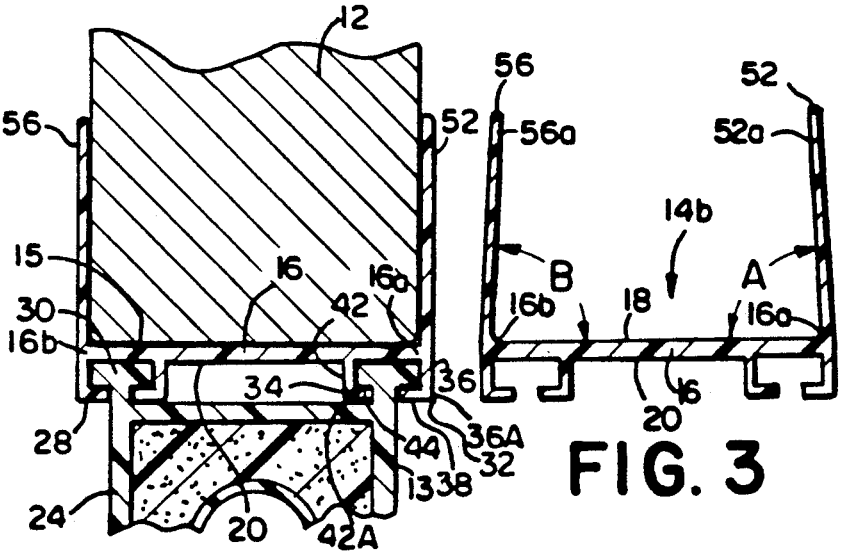
FIG. 3
FIG. 4

FASTENING DEVICE FOR SECURING A SENSING EDGE TO A DOOR

FIELD OF THE INVENTION

The present invention relates to a sensing edge for causing a closing door to open by actuating a device upon force being applied to the sensing edge and, more particularly, to a fastening device for securing such a sensing edge to a door.

BACKGROUND OF THE INVENTION

Conventionally, sensing edges for doors were permanently secured to the leading edge of the door. Typically, such sensing edges were adhesively attached to the leading door edge or standard hardware fasteners (e.g., nails, rivets, etc.) were used to accomplish the same. While these methods were suitable for their intended purpose (i.e., securing the sensing edge to the door), they became problematic if the sensing edge failed and required repair or replacement. Since it is often necessary to remove the sensing edge from the door to effect repairs and the sensing edge was permanently secured to the door, it was difficult to remove the sensing edge without damaging the outer sheath, the door or both.

One attempt to resolve this problem involved cutting a groove or slot directly into the door edge or forming a mortise for receiving a complementary projection or tenon of the sensing edge. For instance, such a sensing edge can be directly secured to a door edge with a pair of T-shaped members which extend from the sensing edge into complementary T-shaped slots in the lower surface of the door.

This practice of securing sensing edges directly to the door, however, is problematic with respect to doors constructed of metallic materials. Heavy metallic doors are typically difficult to drill and/or cut, due to their material properties. As such, the process of securing sensing edges to this type of door is difficult. In addition, even where the door material is conducive to cutting and drilling, installation is expensive because of the complex cutting techniques used and the time required to prepare the door for installation of the sensing edge.

Accordingly, a need has arisen for a method of removably securing a sensing edge to a door without physically altering the door edge.

The present invention overcomes many of the disadvantages inherent in the above-described fastening methods by providing a fastening device which acts as a medium between the door edge and the sensing edge. The fastening device of the present invention eliminates the need for complex cutting and drilling into door edges. By eliminating the need to alter the door edge, the cost and installation time is significantly reduced. Furthermore, the sensing edge is readily removable from the fastening device to thereby promote repair, replacement and installation. Consequently, use of the present invention results in considerable savings in money, as well as time for installation and removal of the sensing edge.

SUMMARY OF THE INVENTION

Briefly stated, the present invention comprises a combination sensing edge for causing a closing door to open and a fastening device for securing the sensing edge to an edge of the door. The combination includes a mounting plate having a first and second surface. The first surface is for being attached to the door edge. A sensing edge is provided to detect objects in proximity to the door edge. The sensing edge includes an elongate sheath which is compressible upon application of external pressure and a switch means for actuating an electrical device upon compression of the sheath. A securing means is interconnected between the second surface of the mounting plate and the sheath to releasably secure the sensing edge to the mounting plate whereby the sensing edge is releasably secured to the door edge.

BRIEF DESCRIPTION OF THE DRAWINGS

The foregoing summary, as well as the following detailed description preferred embodiments, will be better understood when read in conjunction with the appended drawings. For the purpose of illustrating the invention, there is shown in the drawings, embodiments which are presently preferred, it being understood, however, that this invention is not limited to the specific methods and instrumentalities disclosed. In the drawings:

FIG. 1 is an elevational view showing a door construction including a fastening device and a sensing edge in accordance with the present invention;

FIG. 2 is a greatly enlarged partial cross-sectional view of a first preferred embodiment of the fastening device taken along line 2—2 of FIG. 1;

FIG. 3 is a greatly enlarged sectional view of the fastening device of FIG. 1 in accordance with a second preferred embodiment of the present invention;

FIG. 4 is a greatly enlarged partial cross-sectional view of the fastening device of FIG. 1 in accordance with the second preferred embodiment;

DESCRIPTION OF PREFERRED EMBODIMENT

Figure 5:
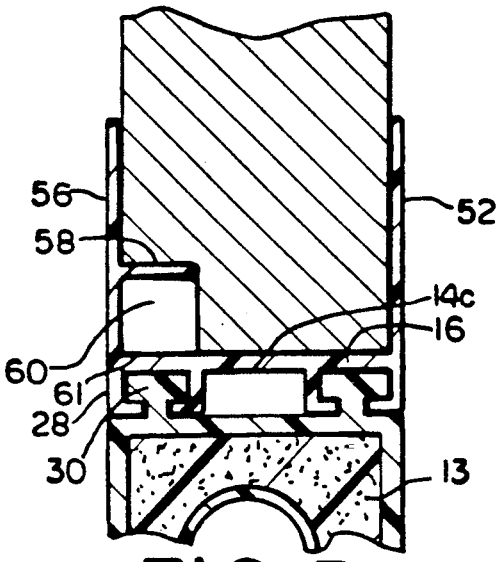
FIG. 5 is a greatly enlarged partial cross-sectional view of the fastening device of FIG. 1 in accordance with a third preferred embodiment of the present invention.

Certain terminology is used in the following description for convenience only and is not limiting. The words "right," "left," "lower" and "upper" designate directions in the drawings to which reference is made. The words "inwardly" and "outwardly" refer to directions toward and away from, respectively, the geometric center of the fastening device and designated parts thereof. The terminology includes the words above specifically mentioned, derivatives thereof and words of similar import.

Referring to the drawings, wherein like numerals indicate like elements throughout, there is shown in FIG. 1 a building wall 10 having a doorway 11 provided with a door 12. The door 12, as illustrated, is an overhead door, having a sensing edge 13 secured to the door 12 by means of a fastening device (not shown in FIG. 1), in accordance with the present invention along its lower side or leading door edge 15. However, it is within the spirit and scope of the invention to incorporate the sensing edge 13 and fastening device described hereinafter along the leading edge of any door structure, such as vertically disposed or horizontally moveable doors, as desired.

Referring now to FIG. 2, there is shown a fastening device 14a in accordance with a first preferred embodiment of the invention. The fastening device 14a includes a generally planar mounting plate 16 which is of a size generally corresponding to or slightly the dimensions of the door edge 15 and which has two primary, generally flat surfaces, a first surface 18 and a second surface 20, respectively. The first surface 18 is for being attached to the leading door edge 15 of the door 12 such that the first surface 18 and the leading door edge 15 of the door 12 are in facing engaging relationship.

In the first preferred embodiment, the mounting plate 16 may be attached to the leading door edge 15 by standard fasteners, such as nails, bolts, screws, tacks or staples. However, it is understood by those skilled in the art, that the mounting plate 16 could be secured to the leading door edge 15 by an adhesive or other fastener means without departing from the spirit and scope of the invention.

In the first preferred embodiment and in the embodiments described hereinafter, the fastening device 14a is elongated and preferably extends along generally the entire width of the leading door edge 15. However, it is understood by those skilled in the art, that in the alternative a series of two or more separately shorter fastening devices could be positioned at spaced locations along the leading door edge 15.

It is preferred that the fastening device 14a be constructed of a polymeric material, such as polyvinylchloride. However, it is understood by those skilled in the art, that other materials could be used to fabricate the fastening device 14a, such as brass or rubber. Preferably, the fastening device 14a is fabricated by an extrusion process. However, it is understood by those skilled in the art, that other fabrication methods could be used.

The sensing edge 13 is used for detecting objects in proximity to the leading door edge 15 during the closing or opening of the door 12 and includes an elongated sheath 24 fabricated of form retaining, flexible air impervious material, such as rubber. The sheath 24 is compressible upon the application of an external pressure or force. Located within the sheath 24 is a switch means which actuates an electrical device (not shown) upon compression of the sheath 24, as is understood by those skilled in the art.

In the first preferred embodiment and in the embodiments described hereinafter, the switch means preferably comprises a sensor (not shown) positioned within the sheath 24 to sense objects in proximity to the leading door edge 15. For example, the switch means or sensor could comprise a force sensing switch 26 for detecting force being applied to the sheath 24. Upon sensing an object in proximity to the leading door edge 15 the force sensing switch 26 actuates the device to either stop the door 12 from moving further or to return the door 12 to the open position. It is understood by those skilled in the art, that the present invention is not limited to any particular switch means or sensing edge 13. For instance, the switch means and/or sensing edge 13 could be of the type disclosed in U.S. Pat. Nos. 3,462,885; 4,785,143; 4,908,483 and 4,920,241 all of which are hereby incorporated by reference.

In the first preferred embodiment, a securing means is interconnected between the second surface 20 of the mounting plate 16 and the sheath 24 for releasably securing the sensing edge 13 to the mounting plate 16 such that the sensing edge 13 is releasably secured to the leading door edge 15. The securing means is comprised of a female member 28 which extends outwardly from the second surface 20 of the mounting plate 16 and a complementary male member 30 which extends outwardly from the sheath 24. The female member 28 preferably extends along the entire length of the mounting plate 16. However, it is understood by those skilled in the art, that in the alternative a series of two or more individual female members may be spaced along the mounting plate 16. The male member 30 is releasably positioned within the female member 28 such that the sensing edge 13 is attached to but readily removable from the mounting plate 16.

In the first preferred embodiment, the female member 28 includes a first generally L-shaped member 32 in cross section and a second generally L-shaped member 34 in cross section. The first generally L-shaped member 32 includes a first leg 36 which extends generally perpendicularly from the second surface 20 of the mounting plate 16. A second leg 38 extends from the distal end 36a of the first leg 36 generally parallel to the mounting plate 16 for forming half of the female member 28. A second generally L-shaped member 34 mirrors the first generally L-shaped member 32 and forms the second half of the female member 28. The second generally L-shaped member 34 includes a first leg 42 which also extends generally perpendicularly from the second surface 20 of the mounting plate 16. A second leg 44 extends from the distal end 42a of the first leg 42 generally parallel to the mounting plate 16. The first generally L-shaped member 32 and the second generally L-shaped member 34 are spaced apart and cooperate to form with the mounting plate 16 a slot 46 for receiving the male member 30 of the sheath 24. Preferably, the male member 30 is complementary in size to the slot 46 and is generally T-shaped in cross section such that the male member 30 is slidably disposed within the female member 28.

While the above description is directed to single male and female members 30, 28 extending between the sensing edge 13 and the mounting plate 16, it is preferred that a pair of spaced male and female members 30, 28 as illustrated in FIG. 2 extend between the sensing edge 13 and mounting plate 16. However, it is understood by those skilled in the art, that any number of such male and female members may extend between the sensing edge 13 and mounting plate 16. Moreover, the present invention is not limited to any particular securing means or any particular male and female member shape or configuration. For instance, the male and female members could be of a dovetail slot configuration.

Referring now to FIGS. 3 and 4, a fastening device 14b in accordance with a second preferred embodiment of the invention is shown. The fastening device 14b in this embodiment is designed to clamp onto the leading door edge 15 without the need for adhesive or any other fastener means which engages or enters the door 12. The fastening device 14b includes a mounting plate 16 for being attached to the leading door edge 15. The mounting plate 16 has a first end 16a, a second end 16b, and includes a first surface 18 and a second or exterior surface 20. The first and second surfaces 18, 20 are generally planar and preferably extend generally parallel with respect to each other.

A first elongated clamping member 52 extends from the first end 16a of the mounting plate 16 forming an angle A between the first elongated clamping member 52 and the mounting plate 16. In the second preferred embodiment, it is preferred that the angle A be approximately 80°. However, it is understood by those skilled in the art, that the present invention is not limited to any particular angle A so long as it is less than 90°.

A second elongated clamping member 56 extends outwardly from the second end 16*b* of the mounting plate 16 toward the first clamping member 52 for receiving the leading door edge 15 therebetween. The angle B formed between the mounting plate 16 and the second clamping member 56 is preferably approximately 80°. However, it is understood by those skilled in the art, that the present invention is not limited to any particular angle B so long as it is less than 90°.

The first and second clamping members 52, 56, and the mounting plate 16 form a generally trihedrally shaped fastening device wherein the distance between the distal ends 52*a*, 56*a* of the first and second clamping members 52, 56 is less than the width W of the leading door edge 15. In the second preferred embodiment, it is preferred that the fastening device 14*b* be constructed of a generally flexible polymeric material such that the first and second clamping members 52, 56 can be forced slightly outwardly to receive the leading door edge 15. That is, the first and second clamping members 52, 56 are biased inwardly such that once the leading door edge 15 is positioned therebetween, the first and second clamping members 52, 56 exert an inwardly directed force on the door 12 to firmly grip and thereby secure the fastening device 14*b* to the door 12 as illustrated in FIG. 4.

Referring now to FIG. 4, the fastening device 14*b* includes securing means located on the second or exterior surface 20 of the mounting plate 16 for releasably securing the sensing edge 13 to the mounting plate 16 such that the sensing edge 13 is releasably secured to the leading door edge 15. In the second preferred embodiment, the securing means preferably comprises a pair of female members 28 which extend outwardly from the second surface 20 of the mounting plate 16 and a corresponding pair of male members 30 which extend outwardly from the sensing edge 13, as described above in connection with the first preferred embodiment.

Referring now to FIG. 5, there is shown a fastening device 14*c* in accordance with a third preferred embodiment of the invention. The fastening device 14*c* is generally identical to the fastening device 14*b* of the second preferred embodiment, except it further includes a branch member 58 that extends from the second clamping member 56 and is generally parallel to the mounting plate 16. The branch member 58 preferably extends generally perpendicularly from the second clamping member 56 towards the first clamping member 52, such that it is positioned within a complementary slot or groove 60 located on the leading door edge 15. The groove 60 is of the type usually found in doors of the "ship lap" design, as is understood by those skilled in the art. The branch member 58 preferably extends along the entire length of the second clamping member 56 to provide the fastening device 14*c* with structural integrity since the corner 61 of the same would not be supported by the leading door edge 15. The location of the branch member 58 relative to the mounting plate 16 may vary depending upon the particular application and location of the groove 60. Similarly the width and length of the branch member 58 may also vary with the size of the groove 60 and vice versa.

Figure 6:
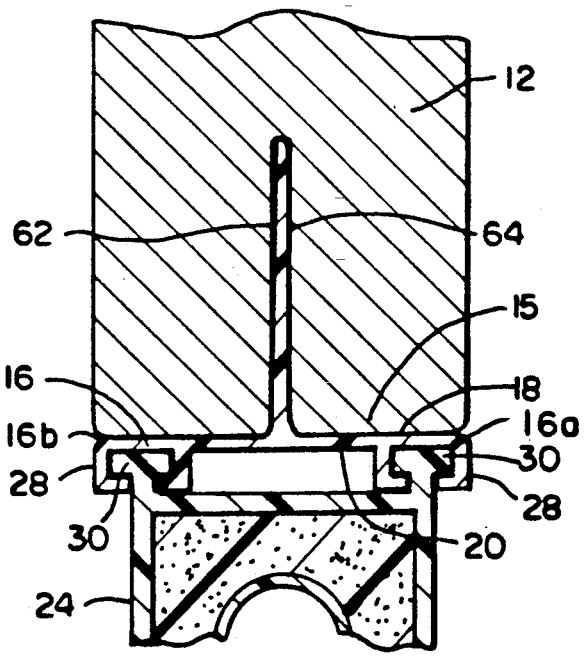
FIG. 6 is a greatly enlarged partial cross-sectional view of the fastening device of FIG. 1 in accordance with a fourth preferred embodiment of the present invention.

Referring now to FIG. 6, a fastening device 14*d*, in accordance with a fourth preferred embodiment of the invention is shown. The fastening device 14*d* includes a mounting plate 16 for being attached to the leading door edge 15. The mounting plate 16 includes a first end 16*a*, a second end 16*b*, a first surface 18 and a second surface 20.

A mounting member 62 extends from the first surface 18 of the mounting plate 16 and is positioned within a complementary slot 64 located in the leading door edge 15. As shown in FIG. 6, the slot 64 is simply constructed to allow for relative ease in installing the fastening device 14*d*.

In the fourth preferred embodiment, the mounting member 62 preferably comprises an elongate generally planar figure which extends generally perpendicularly from the first surface 18 of the mounting plate 16. However, it is understood by those skilled in the art, that the mounting member 62 could extend from the first surface 18 at any angle with respect thereto so long as the slot 64 is complementarily positioned within the leading door edge 15.

While in the fourth preferred embodiment, the fastening device 14*d* includes a single mounting member 62, it is understood by those skilled in the art, that any number of mounting members 62 could extend from the mounting plate 16 into a corresponding number of slots 64 in the leading door edge 15. For instance, a pair of equidistantly spaced mounting members (not shown) could extend from the mounting plate 16. Similarly, a series of aligned mounting members (not shown) could be intermittently spaced across the length of the mounting plate 16.

In the fourth preferred embodiment, the mounting member 62 is preferably adhesively secured within the slot 64. However, it is understood by those skilled in the art, that the mounting member 62 could be secured within the slot 64 in any suitable manner. For instance, the mounting member 62 could be frictionally fit within the slot 64 without departing from the spirit and scope of the invention.

The fastening device 14*d* preferably includes securing means interconnected between the second surface 20 of the mounting plate 16 and the sheath 24 for releasably securing the sensing edge 13 to the mounting plate 16 such that the sensing edge 13 is releasably secured to the leading door edge 15. The securing means preferably comprises a pair of elongated female members 28 which extend outwardly from the second surface 20 of the mounting plate 16 and a corresponding pair of elongated male members 30 which extend outwardly from the sensing edge 13, as described above in connection with the first preferred embodiment. As such, further description of the male and female members 30, 28 is omitted for convenience only and is not limiting.

In use, the appropriate fastening device for the leading door edge is selected. The fastening device is then secured to the leading door edge 15 by adhesive, friction or other fastener means, as described above. The sensing edge 13 is then releasably attached to the fastening device by interlocking the male and female members 30, 28. Accordingly, the sensing edge 13 is readily removable from the fastening device to thereby promote repair, replacement and reinstallation.

From the foregoing description, it can be seen that the present invention comprises a fastening device for releasably securing a sensing edge to a door edge. It will be appreciated by those skilled in the art, that changes could be made to the embodiment described above without departing from the inventive concepts thereof. It is understood, therefore, that this invention is not limited to the particular embodiments disclosed, but is intended to cover all modifications which are within the scope and spirit of the invention as defined by the appended claims.

We claim:

1. A combination sensing edge for causing a closing door to open and a fastening device for securing the sensing edge to an edge of a door, said combination comprising:

a mounting plate for being attached to a door edge, said mounting plate having a first end and a second end and first and second surfaces;

a first elongated clamping member extending from said first end of said mounting plate to thereby form an angle therebetween, said angle being less than 90°;

a second elongated clamping member extending from said second end of said mounting plate at an angle of less than 90°, such that the first and second clamping members extend inwardly toward each other with the mounting plate, said first clamping member and said second clamping member being generally trihedrally shaped in cross section to form a slot for receiving the door edge and for attaching the mounting plate thereto;

a sensing edge for detecting an object in proximity to said door edge, said sensing edge comprising:

an elongate sheath compressible upon application of external pressure for being attached to said mounting plate, and a force sensing switch for detecting force being applied to said sheath; and securing means interconnected between said second surface of said mounting plate and said sheath for releasably securing said sensing edge to said mounting plate whereby the sensing edge is releasably secured to said door edge.

2. The fastening device as recited in claim 1, wherein said securing means comprises a male member extending outwardly from one of said sheath and said mounting plate for receiving a complementary female member extending outwardly from the other of said mounting plate and said sheath, said male member being releasably positioned within said female member.

3. The fastening device as recited in claim 2, wherein said female member comprises a first generally L-shaped member in cross section and a second generally L-shaped member in cross section, said first generally L-shaped member including a first leg extending generally perpendicularly from one of said sheath and said end of said mounting plate and a second leg extending from a distal end of said first leg towards said second generally L-shaped member, said second generally L-shaped member including a first leg extending generally perpendicularly from said one of said sheath and said end of said mounting plate and a second leg extending from a distal end of said first leg of said second generally L-shaped member toward said second leg of said first generally L-shaped member, said first and second generally L-shaped members being spaced apart to form a slot therebetween for receiving the male member.

4. The fastening device as recited in claim 1, wherein said female member comprises a first generally L-shaped member in cross section and a second generally L-shaped member in cross section, said first generally L-shaped member including a first leg extending generally perpendicularly from said end of said mounting plate and a second leg extending from a distal end of said first leg towards said second generally L-shaped member, said second generally L-shaped member including a first leg extending generally perpendicularly from said end of said mounting plate and a second leg extending from a distal end of said first leg of said second generally L-shaped member toward said second leg of said first generally L-shaped member, said first and second generally L-shaped members being spaced apart to form a slot therebetween for receiving the male member of said sheath.

5. The fastening device as recited in claim 4, wherein said mounting plate is constructed of a polymeric material.

6. A combination sensing edge for causing a closing door to open and a fastening device for securing the sensing edge to an edge of a door, said combination comprising:

a mounting plate for being attached to the door edge, said mounting plate having a first surface and a second surface;

a mounting member extending from the first surface of the mounting plate for being positioned within a complementary slot in the door edge;

a sensing edge for detecting an object in proximity to said door edge, said sensing edge comprising:

an elongate sheath compressible upon application of external pressure for being attached to said mounting plate;

a force sensing switch for detecting force being applied to said sheath; and securing means interconnected between the second surface of said mounting plate and said sheath for releasably securing said sensing edge to said mounting plate whereby the sensing edge is releasably secured to said leading door edge, said securing means comprising a female member extending outwardly from one of said second surface of said mounting plate and said sheath for receiving a complementary male member extending outwardly from the other of said second surface of said mounting plate and said sheath, said male member being releasably positioned within said female member, said female member comprises a first generally L-shaped member in cross section and a second generally L-shaped member in cross section, said first generally L-shaped member including a first leg extending generally perpendicularly from one of said second surface of said mounting plate and said sheath and a second leg extending from a distal end of said first leg towards said second generally L-shaped member, said second generally L-shaped member including a first leg extending generally perpendicularly from said one of said second surface of said mounting plate and said sheath and a second leg extending from a distal end of said first leg of said second generally L-shaped member toward said second leg of said first generally L-shaped member, said first and second generally L-shaped members being spaced apart to form a slot therebetween for receiving the male member.

7. The fastening device as recited in claim 1, wherein said securing means is a female member extending outwardly from said end of said mounting plate for receiving a complementary male member extending outwardly from said sheath, said male member being releasably positioned within said female member.

8. A fastening device for securing a sensing edge to a door edge, said fastening device comprising:

a mounting plate for being attached to a door edge, said mounting plate having a first end and a second end and first and second surfaces;

a first elongated clamping member extending from said first end of said mounting plate to thereby form an angle therebetween, said angle being less than 90°;

a second elongated clamping member extending from said second end of said mounting plate at an angle of less than 90°, such that the first and second clamping member extend inwardly toward each other with the mounting plate, said first clamping member and said second clamping member being generally trihedrally shaped in cross section to form a slot form receiving the door edge and for attaching the mounting plate member thereto;

a branch member extending from one of said clamping members toward the other of said clamping members and generally parallel to said mounting plate, said branch member being positioned inwardly from a distal end of said one clamping member for being positioned within a complementary groove located on the door edge; and securing means located on the second surface of said mounting plate for releasably securing the sensing edge to said mounting whereby the sensing edge is releasably secured to said door edge.

* * * * *